United States Patent [19]

Huff et al.

[11] 4,125,289

[45] Nov. 14, 1978

[54] METHOD FOR IN SITU MINEFIELDS

[75] Inventors: Ray V. Huff, Thatcher, Ariz.; Donald H. Davidson, Bedford, Mass.

[73] Assignee: Kennecott Copper Corporation, New York, N.Y.

[21] Appl. No.: 864,145

[22] Filed: Dec. 23, 1977

Related U.S. Application Data

[62] Division of Ser. No. 736,301, Oct. 28, 1976, abandoned.

[51] Int. Cl.[2] ..... E21B 43/00

[52] U.S. Cl. ..... 299/4; 166/57; 166/302; 166/DIG. 1

[58] Field of Search ..... 166/302, 57, 62, 317, 166/318, DIG. 1; 299/4; 175/17

[56] References Cited

U.S. PATENT DOCUMENTS

| | | | |
|---|---|---|---|
| 556,651 | 3/1896 | Van Dyke | 166/307 |
| 1,012,777 | 12/1911 | Wigle | 166/57 UX |
| 3,007,523 | 11/1961 | Vincent | 166/318 X |
| 3,130,789 | 4/1964 | Alexander et al. | 166/317 |
| 3,160,208 | 12/1964 | Jorda | 166/57 |
| 3,841,705 | 10/1974 | Girard | 299/4 |

*Primary Examiner*—Ernest R. Purser
*Assistant Examiner*—William F. Pate, III
*Attorney, Agent, or Firm*—John L. Sniado; Anthony M. Lorusso

[57] ABSTRACT

A circulation tubing string is disposed about the lixiviant return tubing string in the production hole of an in situ minefield. The circulation string extends from the surface to a point near a packer which defines the top of the leaching interval. A fluid coupler provides a fluid flow path between the annular cross-section regions between the production hole casing and the circulation string, and between the circulation string and the lixiviant return string. A flow of cooling fluid is maintained from the surface through the circuital path defined by the annular cross-section regions and the fluid coupler, particularly including the exterior surface of the production tubing string. The fluid is maintained at a temperature and flow rate so that the pregnant leach liquor flows in the production tubing string between the leaching interval and the surface is characterized by a predetermined temperature drop.

3 Claims, 1 Drawing Figure

METHOD FOR IN SITU MINEFIELDS

This is a divisional, of application Ser. No. 736,301 filed Oct. 28, 1976, now abandoned.

BACKGROUND OF THE INVENTION

The present invention relates to in situ mining of metal values, and more particularly, to downhole heat exchangers for cooling the pregnant leaching liquor in the production holes of an in situ minefield.

The subject matter of the present invention is related to the subject matter of the Patent Application Ser. No. 724,548, filed on Sept. 20, 1976, and entitled "In Situ Mining Method and Apparatus". That application is incorporated by reference in the present application.

As noted in the incorporated reference, much contemporary effort is directed to the development of processes in hardware permitting the efficient and economic extraction of metal values from the low grade porphyry ores residing in relatively large, deep-lying deposits, whereby the metal value extraction may be accomplished with minimal environmental impact.

Generally, in situ mining processes require at least two bore holes drilled to the lowermost level of the desired leaching interval in the ore deposit. A packer and lixiviant injector is then affixed to the interior of a first, or injection, hole at the top of the desired leaching interval. Leach liquor is pumped down the injection hole and into the leaching interval to establish a relatively high pressure reservoir of leach liquor in the portion of the injection hole in the leaching interval. A relatively low pressure is established in one or more nearby production holes at portions of those holes lying within the leaching interval. Lixiviant from the injection hole passes through fissures in the ore along a pressure gradient between the injection hole and the production holes. As the lixiviant passes through the ore, metal values are leached. The pregnant leach liquor is pumped to the surface by way of the production holes and processed to recover the leached metal values.

The effective heat transfer coefficient in production holes is severely limited by the surrounding rock formation and the cement used to case the hole (for example, for a 9½ inch diameter production hole, the effective heat transfer coefficient for the rock formation may be of the order of 1.5 to 0.7 Btu/hr°Fft$^2$, with the cement casing and other factors reducing this to provide an overall heat transfer coefficient in a range of 0.6 to 0.4 Btu/hr°Fft$^2$). At these levels, and with the typical production hole flow rates on the order of 120 gpm, the heat exchange between the pregnant leach liquor and the rock formation, as the liquor travels to the surface, is very small and the leach liquor effectively arrives at the surface substantially at the average geothermal temperature of the leaching interval.

As exemplified by the incorporated reference, in-situ mining techniques require considerable chemical processing at surface plants to extract the leached metal values from the pregnant liquor returned by way of the production holes. For example, in the ammoniated lixiviant process disclosed by the incorporated reference, the surface processing requires an ion exchange plant, operating at a near-atmospheric pressure environment for the leach liquor. However, for deep well insitu minefields (on the order of 3,000 feet), the ambient geothermal temperature in the leaching interval is typically on the order of 100° C. Accordingly, in deep well in-situ minefields, the pregnant leach liquor removed from the production holes is also at a temperature of the order of 100° C. At these temperatures and in the relatively near-atmospheric pressure environment of the surface metal value extraction plant, typically-used lixiviants boil off. Consequently, the systems of the prior art require that lixiviant be constantly replaced in the mine system at the injection holes, or, alternatively, a surface cooling plant is needed for reducing the pregnant leach liquor temperature to the temperatures of the order of 40° C. prior to the metal value extraction processing. The cost of either alternative detracts substantially from the many favorable economic factors associated with in situ mining.

Furthermore, it is well known that stainless steel tubing strings are well suited, particularly in terms of convenience and ease of use, for providing the production hole conduit for removing the pregnant leach liquor from the leaching interval. However, such tubing strings are not generally used due to their relatively high cost, particularly in deep mine environments. Tubing strings made of less expensive material such as fiberglass reinforced plastic (FRP) are typically used. While such tubing strings are relatively inconvenient and difficult to handle, the considerable saving offsets the difficulty factor in terms of economic operating conditions for in situ mines using conventional technology.

It is an object of the present invention to provide sufficiently effective downhole heat exchangers for the production holes of in situ minefields to eliminate, or substantially reduce, the requirement for surface heat exchangers prior to ion exchange processing for metal value extraction.

It is a further object of the present invention to provide downhole heat exchangers having relatively high thermal conductivity, metallic tubing strings for the production holes of in-situ minefields wherein the heat exchangers offset the economic disadvantage normally involved in using such tubing strings in the production holes.

SUMMARY OF THE INVENTION

According to the present invention, each injection hole in an in-situ minefield is accompanied by at least one nearby production hole extending to and including the leaching interval. Each production hole includes a peripherally disposed casing and a central lixiviant-return, or production, tubing string, each extending to the leaching interval. A packer is disposed at the uppermost portion of the leaching interval and isolates the region within the production hole in the leaching interval from the region within the casing and exterior to the production string, while coupling the former region to the region interior to the production string.

In addition, a circulation tubing string, having a diameter greater than the lixiviant-return string and less than the production hole casing, is maintained in an arrangement substantially concentric with the production tubing string. Near the leaching interval, a fluid coupler is provided to establish a fluid flow path between the outer and inner annular cross-section regions, respectively between the hole casing and the circulation string, and between the circulation string and the production string. A cooling liquid is pumped from the surface to the coupler by way of the inner annular cross-section region and then through the coupler and back to the surface by way of the outer annular cross-section region. By controlling the temperature and flow rate of the cooling fluid in relation to the temperature and flow rate of the production hole lixiviant, and also in relation to the surface area and heat transfer coefficient of the circulation tubing string, heat is transferred from the lixiviant across the production tubing string to the cooling fluid so that the temperature of the pregnant leach liquor emerging from the production hole may be maintained at a predetermined value. With suitable control, this value may be selected so that the surface cooling plant for the pregnant leach liquor, which has been typically required for other in situ mining systems, is not required. Accordingly, the pregnant leach liquor may be pumped directly from the production holes to the metal extraction plant for processing.

The elimination of or reduction in cooling capacity of the requirement for the surface leach liquor cooling plant substantially reduces the minefield cost to an extent which may permit the use of stainless steel tubing for the production hole lixiviant-return tubing string, thereby substantially easing the level of difficulty in establishing and maintaining an in situ minefield. For example, the use of stainless steel, as opposed to FRP, in some embodiments, permits a substantial improvement in heat transfer between the production string lixiviant and cooling fluid since typically used FRP tubing is characterized by a heat transfer coefficient of 10 Btu/hr°Fft$^2$ while stainless steel tubing is characterized by a heat transfer coefficient of 100 Btu/hr°Fft$^2$.

DESCRIPTION OF THE PREFERRED EMBODIMENT

Figure 1:
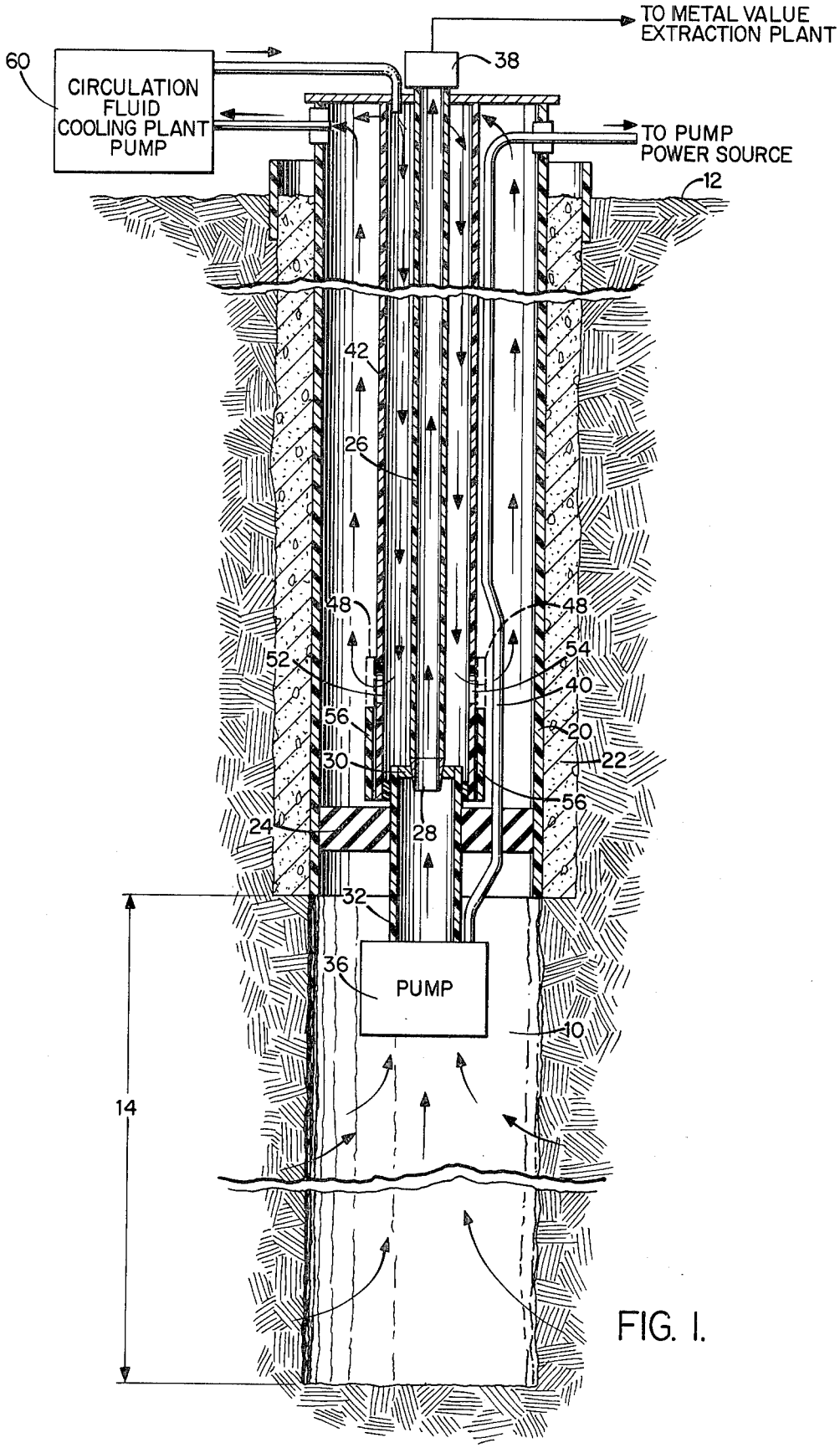

The drawing illustrates a production hole for an in situ minefield in a manner similar to FIG. *2a* of the incorporated reference, but showing the present invention.

In the drawing, a production hole 10 is shown extending from the surface 12 to the lowermost limit of a leaching interval indicated by the arrow 14. As in the incorporated reference, the production hole 10 is lined with a casing 20 extending from the surface to the uppermost limit of the leaching interval 14. The casing 20 is cemented to the surrounding rock formation as indicated by cement 22. A conventional packer assembly 24 is shown to define the uppermost limit of the leaching interval 14. A production string 26 extends through the production hole 10 so that a stinger 28 at its lowermost end is seated in a seating nipple 30 and coupling assembly 32 affixed within hole 10 by the packer 24. A pump 36 is connected to the other end of the coupling assembly 32 within the leaching interval. The pump 36 is adapted to return pregnant leach liquor which enters the portion of hole 10 within the leach interval 14, by way of the production string and a valve 38 at the surface to a metal extraction plant (not shown in the Figure). It will be understood that the packer 24 also provides passage for an electrical power cable 40 extending from a surface power source to the pump 36. With this configuration, a packer effectively isolates the region exterior to production string 26 from the region of production hole 10 within the leaching interval 14. As thus far described, the production hole configuration is considered to be within the teaching set forth by the incorporated reference, and the devices and assemblies described in that reference may be utilized for the corresponding devices and assemblies in the present embodiment.

Also illustrated in the drawing is a circulation tubing string 42 which is substantially concentrically disposed about the production string 26 and extends from the surface to the packer 24, thereby defining a first (inner) annular cross-section region between the circulation string 42 and the production string 26 and a second (outer) annular cross-section region between the casing 20 and circulation string 42. A fluid coupler provides a fluid flow path between the first and second annular regions.

A circulation fluid cooling plant (such as a conventional cooling tower) and pump is illustrated by block 60 in the drawing and includes a means to inject a circulation fluid into the innermost annular region and extract circulation fluid from the outermost annular region by way of conventional valve assemblies.

As illustrated in the drawing, the fluid coupler includes the lowermost portion of circulation string 42 having circulation ports 52 and 54, and a sleeve member 56 which is adapted for selectively controlled motion along circulation string 42 between its illustrated position and the position illustrated by the broken line designated by reference numeral 48. With the sleeve member 56 in its lowermost position, the ports 52 and 54 are full open, thereby permitting maximum fluid coupling between the inner and outer annular cross-section regions adjacent to ports 52 and 54. With the sleeve member in its uppermost position as indicated by reference numeral 48, the ports 52 and 54 are full closed, providing substantially no fluid coupling through the ports.

By way of example, the fluid coupler may comprise a conventional hydraulically-operated pump-down sleeve device. With such a configuration, the production hole configuration may be easily installed with the circulation string, pump-down sleeve device, packer and pump being initially inserted in the hole as an integral assembly, followed by the insertion of the production tube which is stabbed into the seating nipple of the packer/pump assembly. Hydraulic pressure in the circulation string may then be used both to set the packer and to shear pins in the sleeve device so that the sleeve member 56 slides into its illustrated (full open) position and the circulation ports 52 and 54 are fully open. Alternatively, a conventional knock-down sleeve device may also be utilized in place of the pump-down device with this device having the further capability of being reset from the surface to block the circulation parts, thereby interrupting circulation between the annular cross-section regions. Of course the coupler, as described above to include the lowermost portion of circulation string 42 and a sleeve member, is merely exemplary, and alternative means of providing a fluid flow path between the inner and outer annular regions may readily be used in keeping with the present invention. For example, the port 52 alone provides such a path.

In operation, as the pump 36 drives pregnant leach liquor by way of the production string 26 and the valve 28 to the metal extraction plant, the circulation fluid cooling plant and pump 60 drive a cooling fluid by way of the inner annular region, the fluid coupler and the outer annular region in a circuital path (illustrated by the flow arrows in the annular regions in the Figure). The cooling plant and pump 60 maintain the temperature and flow rate of the cooling fluid at appropriate values so that the heat exchange between the pregnant leach liquor and cooling fluid across the production string 26 is sufficient to decrease the temperature of the pregnant leach liquor by a predetermined value between the leaching interval 14 and the surface 12.

By way of example, the above configuration may be implemented by drilling a 10⅝ inch production hole to the casing setting depth, i.e., to the uppermost portion of the desired leaching interval. A $10\frac{5}{8}$ inch or smaller hole may then be drilled to the lowermost depth of the leaching interval to establish the collection region for the pregnant leach liquor prior to pumping up to the surface. Following the setting of an $8\frac{5}{8}$ inch casing, a corrosion-resistant REDA pump, duo packer, fluid coupling device, and seating nipple and power cable is then run into the production hole at the end of a $4\frac{1}{2}$ inch carbon steel tubing (i.e., the circulation string 42). The packer is then set either hydraulically or mechanically, and the fluid coupling device set to its operating condition, i.e., with the fluid flow ports fully open. At that time, a $2\frac{7}{8}$ inch stainless steel production tubing string having a stinger at the end may be stabbed into the seating nipple associated with the pump affixed to the packer. With the stainless steel production tubing string, a suitable cooling fluid is water mixed with a conventional corrosion inhibitor.

With the above configuration, the cumulative production tubing string surface area for a 25 hole array, 3,000-foot minefield is on the order of 50,000 square feet. At production hole flow rates of 120 gpm, and with 30° C. inhibited water cooling fluid at a 720 gpm flow rate, the heat exchanger configuration reduces the temperature of the pregnant leach liquor from 100° C. at the leaching interval to 40° C. at the surface.

Of course, alternative tubing diameters, flow rates, temperatures, and well depth parameters may readily be used in keeping with the present invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A method for cooling pregnant liquor being flowed to a metal value extraction plant through a production hole of an in situ minefield comprising the following steps:

a. providing an injection hole for said in situ minefield;

b. providing at least one production hole for returning liquid leach liquor injected through said injection hole to the surface, said production hole extending from the surface to a leaching interval, each production hole including a casing extending to said interval, a production tube string disposed concentrically within said casing and extending to said leaching interval, a circulation tubing string disposed concentrically about said production tube string and concentrically within said casing, and a packer means disposed at the top of said leaching interval to isolate the region of said production hole in said interval from the region between the production tube string and said casing and, fluid coupling means for establishing a fluid flow path through the circulating tubing string at a point near the packer;

c. pumping the pregnant leach liquor from the leaching interval below the packer through the production tube string to a metal value extraction plant;

d. pumping a circulating cooling fluid from a cooling plant located on the surface to the space between said production tube string and circulating tube string to cool the pregnant leach liquor travelling up said production tube string, said cooling fluid flowing down the space between the production tube string and the circulation tube string to a point near the packer and through the circulation tube string to flow up the production hole and the space between the circulation tube string and the casing; and, e. delivering said cooling fluid to a cooling plant to cool the cooling fluid to a predetermined value, said predetermined value being selected to provide sufficient heat exchange in the production hole to substantially reduce the requirement for surface heat exchangers prior to ion exchange of the metal values in the pregnant liquor.

2. The process as set forth in claim 1 wherein said associated production tube string is characterized by a relatively high heat transfer coefficient.

3. The process as set forth in claim 2 wherein said associated production tubing string is constructed of stainless steel.

* * * * *